US005676611A

United States Patent [19]

Foster et al.

[11] Patent Number: 5,676,611

[45] Date of Patent: Oct. 14, 1997

[54] FORAMINOUS SHELL FOAM FOOTBALL

[75] Inventors: George T. Foster, Long Beach, Calif.; Richard Lok, Tuen Mun, Hong Kong

[73] Assignee: Elliot A. Rudell, Torrance, Calif.

[21] Appl. No.: 751,497

[22] Filed: Nov. 18, 1996

[51] Int. Cl.[6] ..... A63B 39/08

[52] U.S. Cl. ..... 473/613; 473/596

[58] Field of Search ..... 473/569, 570, 473/573, 594, 595, 596, 597, 598, 599, 600, 603, 604, 607, 612, 613, 351, 365, 371, 378; 273/DIG. 20, DIG. 24

[56] References Cited

U.S. PATENT DOCUMENTS

| | | | |
|---|---|---|---|
| 4,772,020 | 9/1988 | Martin | 473/613 |
| 4,874,169 | 10/1989 | Litchfield | 473/613 |
| 4,887,814 | 12/1989 | Winter | 473/596 |
| 5,133,550 | 7/1992 | Handy | 473/596 |
| 5,280,906 | 1/1994 | Vitale | 473/613 |
| 5,451,046 | 9/1995 | Batton | 473/573 |
| 5,460,368 | 10/1995 | Pearson | 473/613 |
| 5,556,342 | 9/1996 | Berberian | 473/378 |

*Primary Examiner*—Steven B. Wong
*Attorney, Agent, or Firm*—Blakely Sokoloff Taylor & Zafman

[57] ABSTRACT

A ball that has a foam outer shell which surrounds a hollow inner chamber. The ball is constructed by initially forming a first section and a separate second section. The first and second foam sections are attached to create a ball with an inner chamber. The outer shell and inner chamber create a moment of inertia that is conducive to a spiral rotation when thrown by a player. Additionally, the soft foam material of the outer shell minimizes the discomfort of catching the ball.

12 Claims, 1 Drawing Sheet

FORAMINOUS SHELL FOAM FOOTBALL

BACKGROUND OF THE INVENTION

1. Field of the Invention

The present invention relates to a foam ball that has a hollow inner chamber.

2. Description of Related Art

There have been developed a variety of different footballs that can be tossed by people of all ages. For example, there has been marketed a soft foam football by Kenner under the trademark NERF. NERF footballs are enjoyable because the ball is soft and easy to catch. Some NERF footballs contain a dimpled and/or ribbed outer surface to improve the grip of the ball. NERF footballs have a uniform weight density throughout the ball. The uniform weight density creates a moment of inertia that is not conducive to a spiral rotation. Consequently, it can be difficult to throw a spiral with a NERF football.

There has been marketed a rigid polyethylene football under the WIFFLE trademark. The WIFFLE footballs contain a hollow inner chamber that is surrounded by an outer plastic shell. The outer shell of the WIFFLE product provides a moment of inertia that is more conducive to throwing the ball with a spiral. Unfortunately, the hard plastic material of the WIFFLE ball is not as easy to catch as the soft NERF footballs. It would therefore be desirable to provide a football that is soft and conducive to throwing a spiral. It would also be desirable to provide a football that has multiple colors to improve the appearance as the ball rotates through the air.

SUMMARY OF THE INVENTION

The present invention is a ball that has a foam outer shell which surrounds a hollow inner chamber. The ball is constructed by initially forming a first section and a separate second section. The first and second foam sections are attached to create a ball with an inner chamber. The outer shell and inner chamber create a moment of inertia that is conducive to a spiral rotation when thrown by a player. Additionally, the soft foam material of the outer shell minimizes the discomfort of catching the ball.

DETAILED DESCRIPTION OF THE INVENTION

Figure 1:
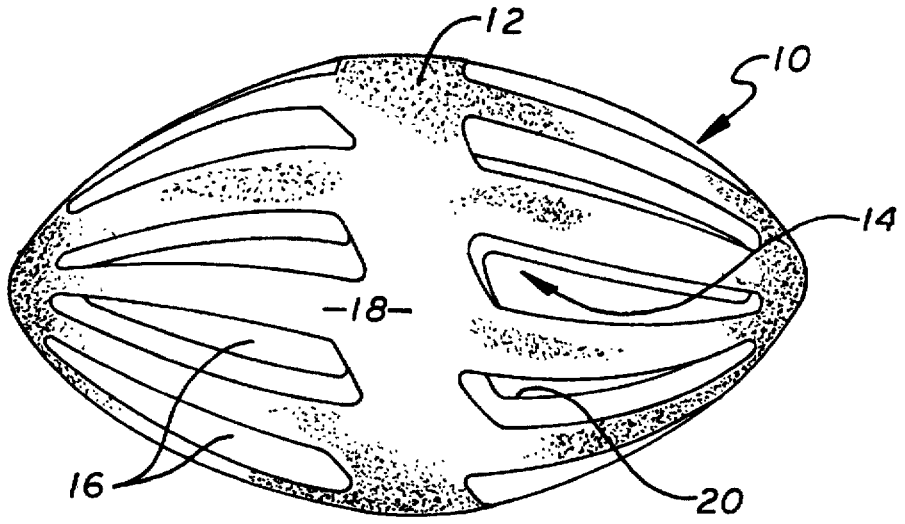
FIG. 1 is a perspective view of a foam football of the present invention.

Referring to the drawings more particularly by reference numbers, FIG. 1 shows a foam ball 10 of the present invention. The ball 10 is preferably shaped as an ellipsoid to simulate a football. Although a football is shown and described, it is to be understood that the ball 10 may have any shape such as a baseball.

The ball 10 has an outer shell 12 that surrounds a hollow inner chamber 14. The outer shell 12 is constructed from a foam material. In the preferred embodiment, the foam material is a polyurethane that is greater than 0.08 inches in thickness. The soft foam material minimizes the discomfort of catching the ball. The outer shell 12 and hollow chamber 14 create a ball which has most of the mass in the outer radial portion of the ball. Locating the mass in the outer radial portion creates a moment of inertia that is conducive to a spiral spin about the longitudinal axis of the ball, when the football 10 is thrown by a player.

The outer shell 12 may have a plurality of slots 16. The slots 16 may extend through the outer shell 12 into the inner chamber 14. Alternatively, the slots 16 may be inset into the surface of the shell 12. In one embodiment, the inset slots 16 have a depth that is greater than 0.03 inches. The outer shell 12 may also have dimples or ridges (not shown) that increase the grip of the ball 10.

Slots 16 extending through the outer shell 12 allow the players to view the inner chamber 14. As one embodiment, the outer surface 18 of the shell 12 may have a different color than the inner surface 20 of the outer shell 12. The different colors provide a unique visual effect when the ball is projected and spinning in the air.

Figure 2:
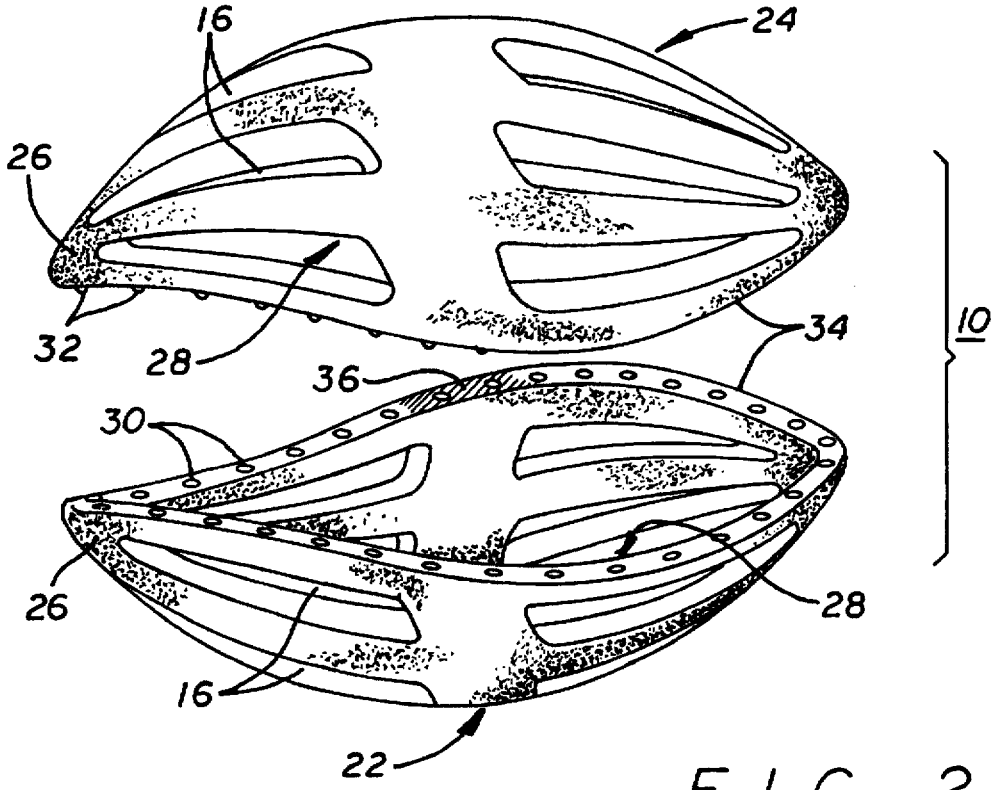
FIG. 2 is a perspective view showing two sections of the foam football.

As shown in FIG. 2, the ball 10 is preferably constructed from a first section 22 and a second section 24. The sections 22 and 24 are typically formed within a mold (not shown). Each section 22 and 24 has an outer shell portion 26 and an inner cavity 28. The sections 22 and 24 may also have slots 16.

The first 22 and second 24 sections are adjoined to create the ball 10 wherein the inner cavities 28 define the inner chamber 14. The first section 22 may have a plurality of holes 30 that receive a plurality of ridges 32 which extend from the second section 24. The ridges 32 increase the resistance to delamination of the ball 10. The sections 22 and 24 may also have arched interface surfaces 34 which further reduce the likelihood of delamination. The first 22 and second 24 sections are preferably attached with a liquefied polyurethane foam material 36 that is applied to the interface surfaces 34 and provides a relatively homogenous seam for the ball 10.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. A ball, comprising:

a foam outer shell that contains an inner chamber and a plurality of slots, wherein said foam outer shell includes a first section and a second section that each have an arched interface, wherein said first section contains a plurality of holes that receive a plurality of ridges of said second section.

2. The ball as recited in claim 1, wherein said inner chamber is hollow.

3. The ball as recited in claim 1, wherein said slots extend into said inner chamber.

4. The ball as recited in claim 1, wherein said foam outer shell has a wall thickness greater than 0.08 inches.

5. The ball as recited in claim 1, wherein said first section is attached to said second section by a layer of foam material.

6. The ball as recited in claim 1, wherein said foam outer shell has an outer surface that has a first color and an inner surface that has a second color.

7. A football, comprising:

an ellipsoid shaped foam outer shell that contains an inner chamber and a plurality of slots, wherein said foam outer shell includes a first section and a second section that each have an arched interface, wherein said first section contains a plurality of holes that receive a plurality of ridges of said second section.

8. The football as recited in claim 7, wherein said inner chamber is hollow.

9. The football as recited in claim 7, wherein said slots extend into said inner chamber.

10. The football as recited in claim 7, wherein said foam outer shell has a wall thickness greater than 0.08 inches.

11. The football as recited in claim 7, wherein said first section is attached to said second section by a layer of foam material.

12. The football as recited in claim 7, wherein said foam outer shell has an outer surface that has a first color and an inner surface that has a second color.

* * * * *